US008272923B2

(12) United States Patent
Schneider et al.

(10) Patent No.: US 8,272,923 B2
(45) Date of Patent: Sep. 25, 2012

(54) METHODS AND APPARATUSES FOR ANVIL RECONDITIONING

(75) Inventors: Uwe Schneider, Cincinnati, OH (US); Robert Charles Dreisig, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 484 days.

(21) Appl. No.: 12/540,544

(22) Filed: Aug. 13, 2009

(65) Prior Publication Data

US 2011/0036217 A1 Feb. 17, 2011

(51) Int. Cl.
*B24B 1/00* (2006.01)

(52) U.S. Cl. ..... 451/49; 451/142

(58) Field of Classification Search ..... 451/49, 451/142

See application file for complete search history.

(56) References Cited

U.S. PATENT DOCUMENTS

| | | | | |
|---|---|---|---|---|
| 92,309 | A * | 7/1869 | Hastings | 451/348 |
| 2,478,485 | A * | 8/1949 | Hewitt, Jr. | 83/107 |
| 5,536,198 | A * | 7/1996 | Grissom et al. | 451/49 |
| 5,562,525 | A * | 10/1996 | Mori et al. | 451/49 |
| 5,738,570 | A * | 4/1998 | Rosenthal et al. | 451/49 |
| 5,997,389 | A * | 12/1999 | Dal Pan et al. | 451/142 |
| 6,244,148 | B1 | 6/2001 | Vees | |
| 6,431,951 | B2 * | 8/2002 | Onose et al. | 451/49 |
| 6,609,997 | B1 * | 8/2003 | Sardella et al. | 451/49 |
| 6,684,747 | B2 | 2/2004 | Aichele | |
| 6,913,566 | B2 | 7/2005 | Polikov et al. | |
| 7,146,893 | B2 | 12/2006 | Aichele | |
| 2004/0110448 | A1 | 6/2004 | Polikov et al. | |
| 2006/0048621 | A1 | 3/2006 | Grenier et al. | |

FOREIGN PATENT DOCUMENTS

| | | | |
|---|---|---|---|
| EP | 1 110 683 | A2 | 6/2001 |
| JP | 1995 256791 | A | 10/1995 |
| JP | 2007256791 | A | 10/2007 |
| WO | WO 2005/005134 | A1 | 1/2005 |

OTHER PUBLICATIONS

PCT International Search Report dated Nov. 17, 2010, 10 pages.

* cited by examiner

*Primary Examiner* — Maurina Rachuba
(74) *Attorney, Agent, or Firm* — Charles R. Matson

(57) ABSTRACT

A rotary cutting apparatus comprises a frame and a die roll defining a first longitudinal axis and comprising a cutting member. The die roll is rotatably connected with the frame and configured to rotate about the first longitudinal axis. The rotary cutting apparatus further comprises a bearer ring connected with the die roll and an anvil roll defining a second longitudinal axis and comprising an outer radial surface. The anvil roll is rotatably connected with the frame and is configured to rotate about the second longitudinal axis. The bearer ring of the die roll is in contact with the outer radial surface. The rotary cutting apparatus further comprises a reconditioning member comprising an abrasive surface engaged with the outer radial surface of the anvil roll. The outer radial surface of the anvil roll moves relative to the abrasive surface.

20 Claims, 8 Drawing Sheets

METHODS AND APPARATUSES FOR ANVIL RECONDITIONING

FIELD OF THE INVENTION

The present disclosure relates generally to rotary cutting apparatuses and, more particularly, relates to methods and apparatuses for reconditioning a surface of an anvil of a rotary cutting apparatus.

BACKGROUND OF THE INVENTION

Rotary cutting apparatuses can comprise a frame, a die roll rotatably mounted to the frame, and an anvil roll rotatably mounted to the frame. The die roll can comprise at least one cutting member for cutting and creasing material against an anvil roll when the material is passed between the die roll and the anvil roll. As the cutting member on the die roll cuts the material, portions of an outer surface of the anvil roll may plastically deform owing to the pressure applied by the cutting member to the portions of the outer surface of the anvil roll. Eventually, the anvil roll may need to be replaced after the portions of the outer surface of the anvil roll have been sufficiently plastically deformed.

In various circumstances, the die roll and the anvil roll can each be driven using a suitable actuator. In other circumstances, the anvil roll can be a "walking anvil" that is rotated via a frictional engagement with the die roll, when the anvil roll is in contact with a portion of the die roll and/or when the anvil roll is in contact with a bearer ring connected with the die roll.

As the anvil roll plastically deforms, owing to the cutting member applying pressure to the anvil roll and plastically deforming the outer surface of the anvil roll, grooves and/or channels may be formed in the outer surface of the anvil roll which may ultimately change the accuracy of the cutting or creasing of the material. In addition, once the anvil roll is sufficiently plastically deformed and/or the diameter of the anvil roll is sufficiently changed, the anvil roll may need to be replaced or refurbished. This replacement or refurbishment may cause downtime of a production line and, therefore, can result in lost production. In view of the importance of anvil roll maintenance and/or the cost of anvil roll replacement, this technology should be improved.

SUMMARY OF THE INVENTION

In one non-limiting embodiment of the present disclosure, a rotary cutting apparatus comprises a frame and a die roll defining a first longitudinal axis and comprising a cutting member. The die roll is rotatably connected with the frame and configured to rotate about the first longitudinal axis. The rotary cutting apparatus further comprises a bearer ring connected with the die roll and an anvil roll defining a second longitudinal axis and comprising an outer radial surface. The anvil roll is rotatably connected with the frame and is configured to rotate about the second longitudinal axis. Additionally, the anvil roll is positioned relative to the die roll such that the bearer ring is in contact with the outer radial surface and such that the first longitudinal axis is substantially parallel with the second longitudinal axis. The rotary cutting apparatus further comprises a reconditioning member comprising an abrasive surface engaged with the outer radial surface of the anvil roll. The outer radial surface of the anvil roll moves relative to the abrasive surface.

In another non-limiting embodiment of the present disclosure, a rotary cutting apparatus comprises a frame and a die roll defining a first longitudinal axis and comprising a cutting member. The die roll is rotatably connected with the frame and is configured to rotate about the first longitudinal axis. The rotary cutting apparatus further comprises an anvil roll defining a second longitudinal axis and comprising an outer radial surface. The anvil roll is rotatably connected with the frame and is configured to rotate about the second longitudinal axis. The anvil roll is movably connected with the frame to allow a distance between the outer radial surface of the anvil roll and the cutting member to be increased and decreased. The rotary cutting apparatus further comprises a reconditioning member comprising an abrasive surface engaged with the outer radial surface of the anvil roll. The outer radial surface of the anvil roll moves relative to the abrasive surface. The rotary cutting apparatus further comprises an actuator connected with the reconditioning member to move the reconditioning member in a reciprocating motion. The reciprocating motion of the reconditioning member is defined by movement of the reconditioning member a first distance in a first direction and by movement of the reconditioning member the first distance in a second direction opposite to the first direction. The abrasive surface defines a first longitudinal length and the outer radial surface of the anvil roll defines a second longitudinal length. The first longitudinal length is equal to or greater than the sum of the second longitudinal length plus the first distance.

In yet another non-limiting embodiment of the present disclosure, a method of reconditioning a rotary cutting apparatus is provided. The method comprises the steps of rotating a die roll, wherein the die roll comprising a cutting member, and rotating an anvil roll, wherein the anvil roll comprising an outer radial surface positioned in close proximity to the cutting member. The method further comprises moving an abrasive surface positioned on a reconditioning member a first distance in a first direction and a second direction opposite the first direction relative to the outer radial surface of the anvil roll. The abrasive surface defines a first longitudinal length and the outer radial surface of the anvil roll defines a second longitudinal length. The first longitudinal length is equal to or greater than the sum of the second longitudinal length plus the first distance.

BRIEF DESCRIPTION OF DRAWINGS

The above-mentioned and other features and advantages of the present disclosure, and the manner of attaining them, will become more apparent and the disclosure itself will be better understood by reference to the following description of non-limiting embodiments of the disclosure taken in conjunction with the accompanying drawings, wherein.

DETAILED DESCRIPTION OF THE INVENTION

Figure 1:
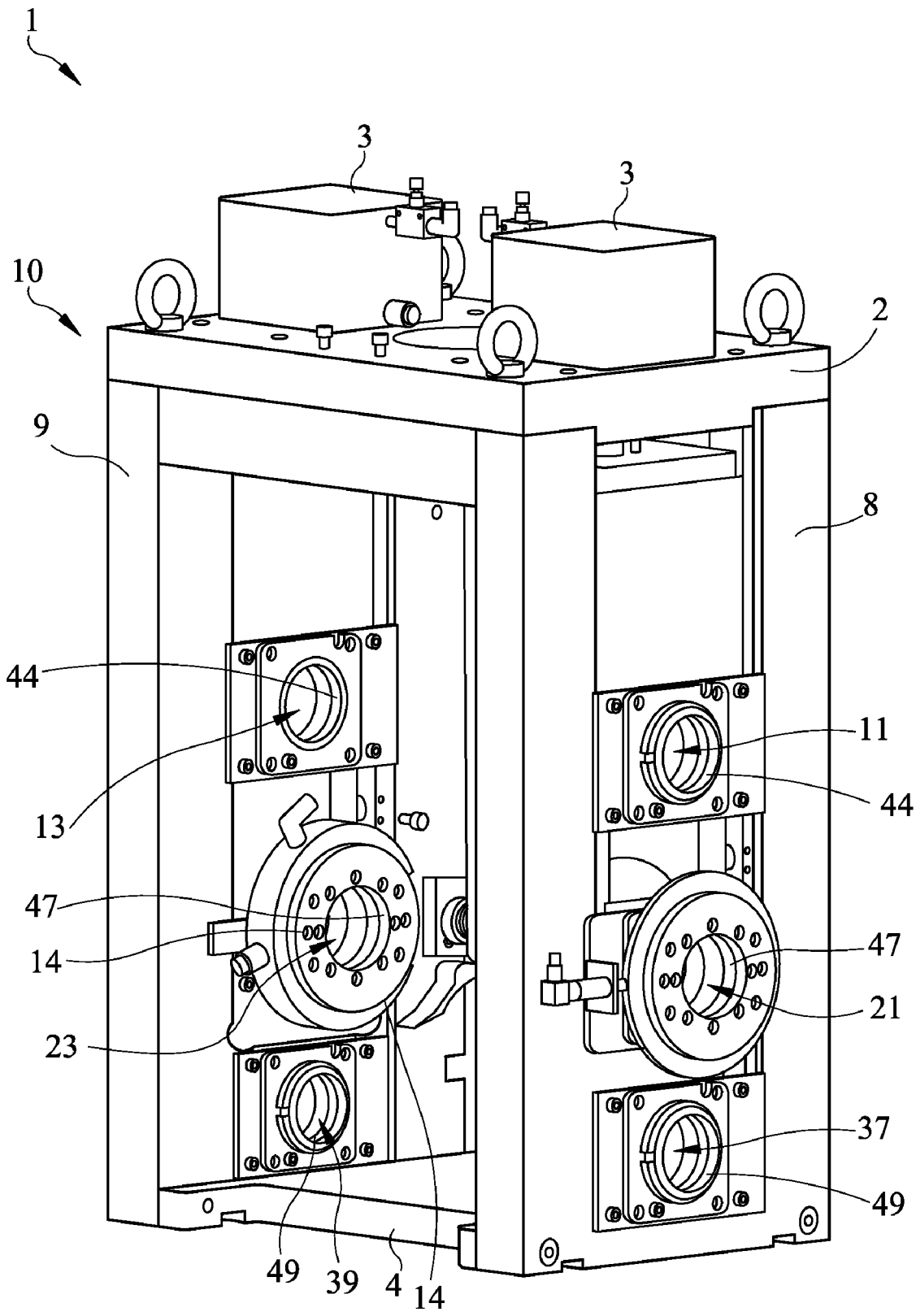
FIG. 1 is a perspective view of a frame of a rotary cutting apparatus according to one non-limiting embodiment.

Various non-limiting embodiments of the present disclosure will now be described to provide an overall understanding of the principles of the structure, function, manufacture, and use of the apparatuses and methods disclosed herein. One or more examples of these non-limiting embodiments are illustrated in the accompanying drawings. It is to be appreciated that the apparatuses and methods specifically described herein and illustrated in the accompanying drawings are non-limiting example embodiments and that the scope of the various non-limiting embodiments of the present disclosure are defined solely by the claims. The features illustrated or described in connection with one non-limiting embodiment may be combined with the features of other non-limiting embodiments. Such modifications and variations are intended to be included within the scope of the present disclosure.

The present disclosure provides apparatuses and methods for reconditioning, refurbishing, and/or polishing an anvil roll of a rotary cutting apparatus. More specifically, the apparatuses and methods may be useful for reconditioning, refurbishing, and/or polishing a surface or a surface material of the anvil roll. It is to be appreciated that other suitable uses for the apparatuses and methods of the present disclosure may be recognized.

In general, a rotary cutting apparatus can comprise a frame, a die roll assembly rotatably attached to the frame, and an anvil roll assembly rotatably attached to the frame. The die roll assembly can comprise a die roll and the anvil roll assembly can comprise an anvil roll. The die roll assembly can also comprise at least one cutting member configured to be forced against the anvil roll, as the anvil roll rotates relative to the die roll, to cut a material being fed through the die roll and the anvil roll. The force of the cutting member on portions of an outer surface of the anvil roll can cause the portions of the outer surface of the anvil roll to plastically deform over time, thereby creating grooves and/or channels near the contact point of the cutting member on the outer surface of the anvil roll which may allow portions of the material being cut to "nest" within the grooves created by the cutting member in the outer surface. The material being cut and/or creased may comprise a non-woven material which may comprise a number of fibers.

The plastic deformation of the outer surface often creates grooves in portions of the outer surface which can adversely affect the quality of the cut and/or crease as the fibers of the non-woven material may nest in the grooves. As the grooves become larger, the cut and/or crease quality may decrease. The possible decrease in the cut and/or crease quality may deteriorate until the non-woven material is not being effectively cut and/or creased by the cutting member. In order to maintain the cut and/or crease quality, an operator may engage the cutting member deeper into the portions of the outer surface of the anvil roll. In some instances, the operator may triple the amount of force applied by the cutting member to the portions of the outer surface, for example. As the operator increases the force applied by the cutting member, the plastic deformation of the portions of the outer surface may become more pronounced. In some instances, the plastic deformation of the portions of the outer surface may create a "mushrooming" effect on the outer surface which may lead to micro-pitting in the portions of the outer surface. As the portions of the outer surface plastically deform to the point where the portions of the outer surface are beginning to extend radially from the outer surface, pieces of the portions of the outer surface may begin to flake away from the outer surface.

Figure 2:
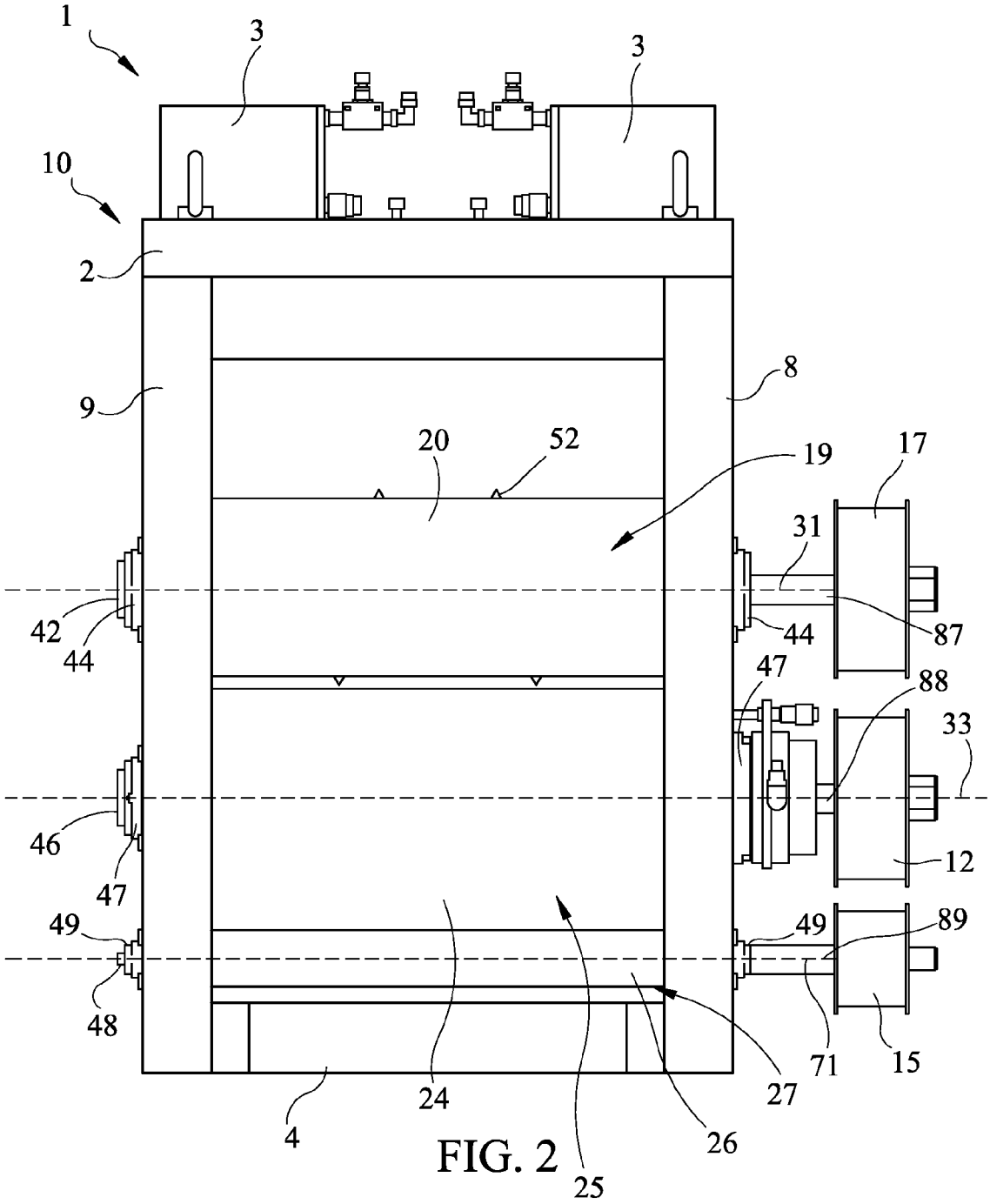
FIG. 2 is a front view of a frame of a rotary cutting apparatus with a rotary cutting assembly positioned thereon according to one non-limiting embodiment.

In one embodiment, referring to FIGS. 1 and 2, a rotary cutting apparatus 1 may comprise a frame 10 comprising a top plate 2, a bottom plate 4, a first side plate 8, and/or a second side plate 9, for example. The first side plate 8 and the second side plate 9 may be connected to the top plate 2 and the bottom plate 4 through various methods, such as bolting, screwing, and/or welding, for example. The bottom plate 4 of the frame 10 may be mounted to a surface or a rigid member to maintain the frame 10 of the rotary cutting apparatus 1 in a fixed position for operation. The mounting of the frame 10 may be accomplished through various methods, such as bolting, screwing, and/or welding, for example.

In one embodiment, again referring to FIGS. 1 and 2, the side plates 8 and 9 of the frame 10 may define openings 11 and 13, respectively, which may receive bearings 44 for accepting a shaft 42 of a die roll assembly 19. The die roll assembly may comprise a die roll 20. Cutting member or knifes 52 may be positioned on the die roll 20. The bearings 44 may be configured to move relative to the frame 10 to allow the die roll 20 to be moved and/or rotate relative to the frame 10. For example, the movement of the bearings 44 may allow a die roll 20 to be moved closer to an anvil roll 24 to allow for the proper amount of cutting force to be applied to the material being cut and/or creased by the cutting members 52. In one embodiment, the material being cut and/or creased may comprise a material, such as polyethylene or polypropylene non-woven material (i.e., spunbound fabric, blow-molded film, extruded film, etc.), configured for use in fabricating absorbent articles, such as diapers, training diapers, pull-up pants, incontinence briefs, and undergarments, for example. In various other embodiments, the material being cut may comprise any material that may be processed by a rotary cutting apparatus, such as corrugated plastic, corrugated fiberboard, card stock, and/or any other suitable material.

In one embodiment, the top plate 2 of the frame 10 may be attached to one or more loading members 3 that may comprise cylinders (not illustrated), such as pneumatic cylinders, hydraulic cylinders, and/or any other suitable loading cylinders, for example. The loading members 3 may be used to apply force to the die roll assembly 19 of the rotary cutting apparatus 1 by extending the cylinders. The most extended end of the cylinders may be engaged with outer rings of the bearings 44 of the die roll assembly 19. The force applied by the loading members 3 to the outer rings of the bearings 44 may be used to provide the proper amount of cutting force to cutting members 52 of the die roll 20 of the die roll assembly 19. The die roll 20 can then be forced against the anvil roll 24 of the anvil roll assembly 25, such that the cutting members 52 of the die roll 20 can cut and/or crease material passing between the die roll 20 and the anvil roll 24 of the rotary cutting apparatus 1.

In one embodiment, the side plates 8 and 9 of the frame 10 may also comprise openings 21 and 23, respectively, which may receive bearings 47 for accepting a shaft 46 of the anvil roll assembly 25. The side plates 8 and 9 may also comprise openings 37 and 39, respectively, which may receive bearings 49 configured to receive a shaft 48 of a reconditioning member assembly 27. The reconditioning member assembly 27 may comprise a reconditioning member, such as reconditioning roll 26, for example. In one embodiment, a drive pulley 17 may be attached to a drive shaft 87 for driving the die roll 20 about a longitudinal axis 31, a drive pulley 12 attached to a drive shaft 88 for driving the anvil roll 24 about a longitudinal axis 33, and/or a drive pulley 15 attached to a drive shaft 89 for driving the reconditioning roll 26 about a longitudinal axis 71. In one embodiment, the frame 10 may comprise vacuum manifolds 14 configured to provide a vacuum for removing waste, such as particulate produced as a result of operation of the rotary cutting apparatus 1, for example.

In one embodiment, referring to FIGS. 3-6, a rotary cutting apparatus 101 may comprise a frame 110, a die roll assembly 119, an anvil roll assembly 125, and a reconditioning member assembly 127. The die roll assembly 119 can comprise a die roll 120 that may define a longitudinal axis 131. The anvil roll assembly 125 can comprise an anvil roll 124 that can define a longitudinal axis 133. The reconditioning member assembly 127 can comprise a reconditioning member, such as reconditioning roll 126, for example, configured to act against and move relative to the anvil roll 124 to remove a portion of an outer radial surface 129 from the anvil roll 124. Unless otherwise indicated, the components with corresponding reference numerals (e.g., 19, 119) can have the same or a similar structure and function as discussed above with respect to other embodiments. As such, these components will not be discussed in detail again, with respect to the rotary cutting apparatus 101, for the sake of brevity.

In one embodiment, again referring to FIGS. 3-6, the die roll 120 may comprise one or more cutting members 152, which may be scoring members and/or blades, for example, or any other suitable cutting members configured for use in the rotary cutting apparatus 101. The cutting members 152 may be positioned on the die roll 120 in a variety of configurations. For example, the cutting members 152 may be positioned partially and/or completely around an outer radial surface 153 of the die roll 120. In one embodiment, the cutting members 152 may also be positioned partially and/or completely across a face of the outer radial surface 153. Each cutting member may be continuous around the perimeter of the die roll 120 or may be discontinuous around the perimeter of the die roll 120. The positioning of the cutting members 152 on the die roll 120 may be dependent on a desired finished product. In one embodiment, the cutting members 152 may be positioned in a continuous manner on the die roll 120 the material is to be continuously cut and the cutting members 152 may be positioned in a discontinuous manner when slits, perforations, and/or any other suitable cuts and/or creases are to be formed in the material. In one embodiment, a continuous cutting member and a discontinuous cutting member may be used in conjunction with each other on the same die roll 120, for example.

In one embodiment, still referring to FIGS. 3-6, the die roll 120 may be rotatably connected with the frame 110 using bearings 144 of the die roll assembly 119 and/or openings 111, 113 of the frame 110. For example, the openings 111, 113 may be formed with a bearing surface which may allow the die roll 120 to be directly mounted within the openings 111, 113. The bearings 144 and the openings 111, 113 may be configured in the same manner as the bearings 44 and the openings 11, 13 discussed above. In various other embodiments, the die roll 120 may be rotatably connected with the frame 110 using a bearing surface, for example. In one embodiment, the bearings 144 may be mounted on a shaft 142 of the die roll assembly 119 using any suitable method for mounting bearings. The die roll 120 may be configured to rotate about the longitudinal axis 131 of the die roll assembly 119. In one embodiment, the die roll assembly 119 may comprise at least one bearer ring 122 connected with the die roll 120. In one embodiment, the at least one bearer ring 122 may be configured to frictionally engage an outer radial surface 129 of the anvil roll 124 and may "drive" the anvil roll 124, owing to a frictional engagement between an outer surface 141 of the bearer rings 122 and the outer radial surface 129 of the anvil roll 124. In such an embodiment, the anvil roll 124 can be considered a "walking" anvil roll.

In one embodiment, the anvil roll assembly 125 may be configured to rotate about the longitudinal axis 133 and may comprise the outer radial surface 129. In one embodiment, the anvil roll 124 may be rotatably connected with the frame 110 using bearings 147 of the anvil roll assembly 125 and/or openings 121, 123 of the frame 110. In one embodiment, the openings 121, 123 may comprise a bearing surface which may allow the anvil roll 124 to be rotatably mounted within the openings 121, 123. In various embodiments, the bearings 147 may be generally the same in structure and function as the bearings 144 discussed above.

In one embodiment, still referring to FIGS. 3-6, the anvil roll 124 may be positioned relative to the die roll 120 such that the outer surface 141 of the at least one bearer ring 122 may be in contact with the outer radial surface 129 of the anvil roll 124. The longitudinal axis 131 of the die roll 120 may be parallel to, or substantially parallel to, the longitudinal axis 133 of the anvil roll 124. In one embodiment, the anvil roll 124 may be formed from a single rigid piece of material or may be formed with a center portion and a surface material at least partially surrounding the center portion. In one embodiment, the anvil roll 124 may comprise tungsten carbide, tool steel, and/or any other suitable materials for forming an anvil roll 124. In various embodiments, the outer radial surface 129 may comprise a material positioned on the anvil roll 124 or integrally formed with the anvil roll 124, such as tungsten carbide, tool steel, and/or any other suitable material for forming the outer radial surface 129 of the anvil roll 124.

Figure 6:
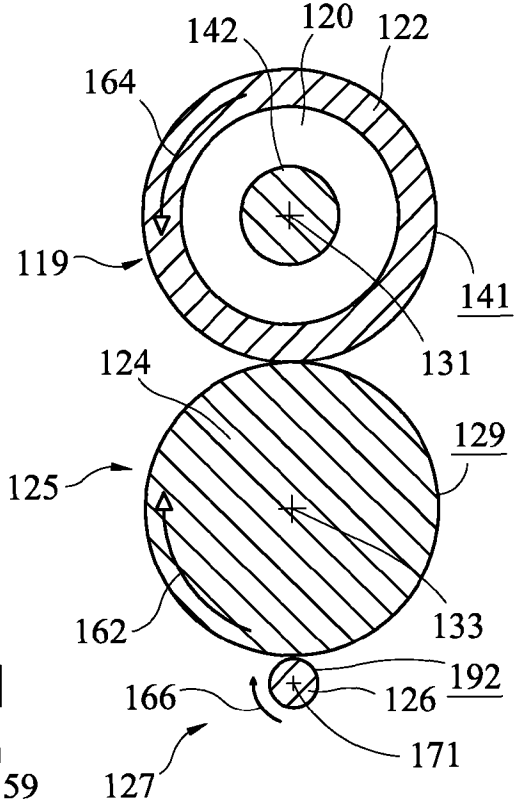
FIG. 6 is a cross-sectional view of the rotary cutting assembly taken along line 6-6 of FIG. 5 according to one non-limiting embodiment.
Figure 5:
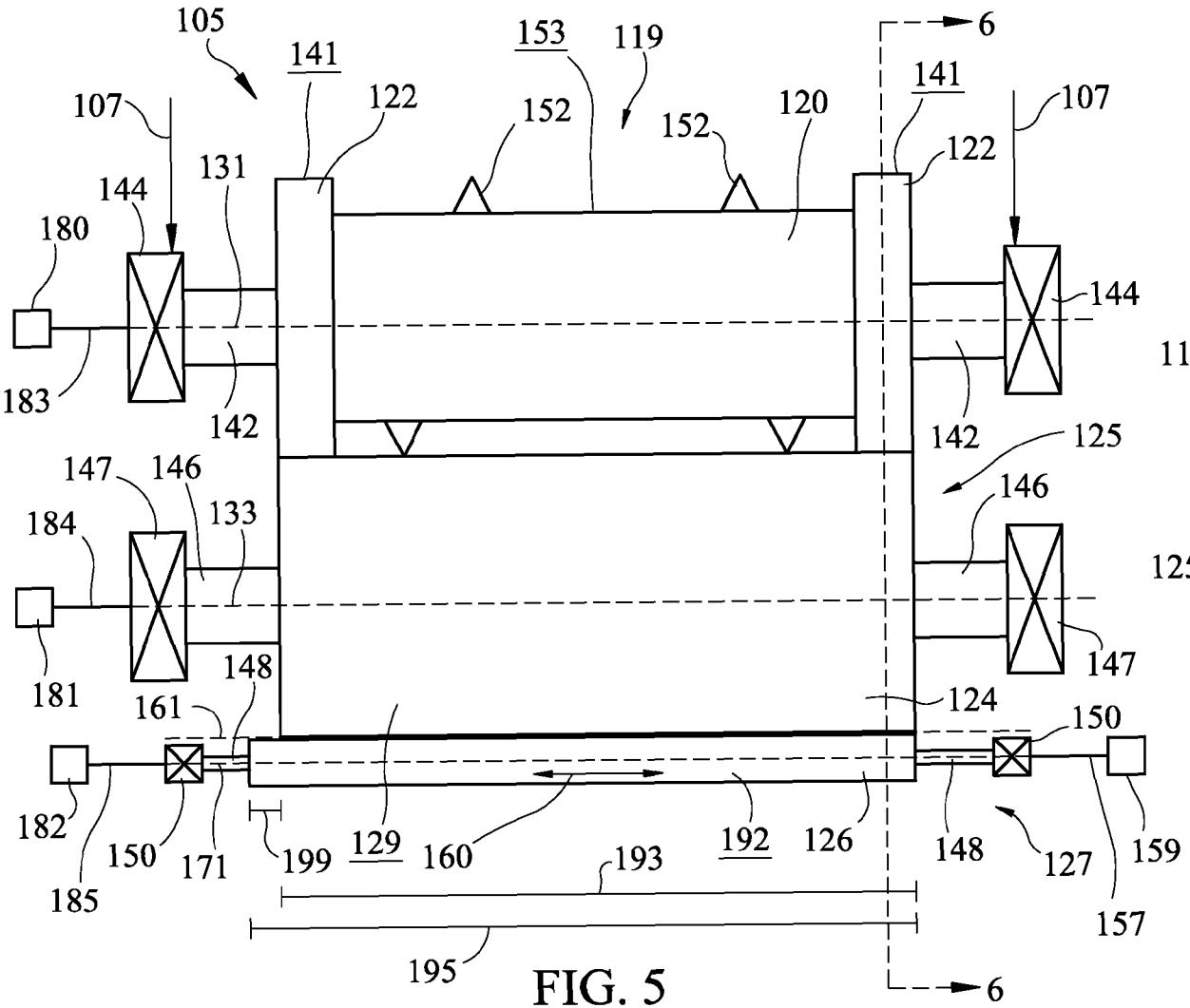
FIG. 5 is a schematic illustration a rotary cutting assembly configured to be mounted to a frame of a rotary cutting apparatus according to one non-limiting embodiment.

In one embodiment, referring to FIGS. 5-6, the die roll 120 may be driven by a motor assembly 180. The motor assembly 180 may comprise a power source and any suitable motor or other device for imparting a rotation upon a shaft 142. The motor assembly 180 may be configured to be engaged with the shaft 142 of the die roll assembly 119 through a drive shaft 183. The motor assembly 180 may rotate the outer surface 141 of the bearer rings 122, owing to the engagement of the bearer rings 122 with the die roll 122, at a first speed. The outer surface 141 of each of the bearer rings 122 may be configured to engage the outer radial surface 129 of the anvil roll 124 to drive the anvil roll 124 owing to frictional engagement between the outer surface 141 of the bearer rings 122 and the and the outer radial surface 129. In one embodiment, the outer radial surface 129 of the anvil roll 124 can then rotate at a second speed. The speed of the outer surface 141 of the bearer rings 122 may be the same as or substantially the same as the speed of the outer radial surface 129 of the anvil roll 124. In one embodiment, the die roll 120 may be rotated by the motor assembly 180 in a direction indicated by arrow 164, and the anvil roll 120 may be rotated (owing to the outer radial surface 129 of the anvil roll 124 being engaged with outer surfaces 141 of the bearing rings 122) in direction indicated by arrow 162. The first direction 164 may be opposite to the second direction 162.

Loading members 3 (see e.g., FIGS. 1-2) may be used to apply a force in a direction indicated by arrow 107 to an outer ring of the bearings 144. The force 107 may be applied to the outer ring of the bearings 144 to cause the outer surfaces 141 of the bearer rings 122 to frictionally engage the outer radial surface 129 of the anvil roll 124. The amount of the force 107 may be increased and/or decreased to create a suitable pressure between the outer surfaces 141 of the bearer rings 122 and the outer radial surface 129 of the anvil roll 124.

In one embodiment, the anvil roll 124 may be driven by a motor assembly 181. The motor assembly 181 may comprise a power source and any suitable motor or other device for imparting a rotation upon shaft 146. The motor assembly 181 may be engaged with the shaft 146 of the anvil roll 124 through a drive shaft 184.

In one embodiment, referring to FIGS. 3-6, 9, and 10, an anvil reconditioning member may comprise a reconditioning roll 126, a reconditioning pad 372 (see, e.g., FIG. 9), a reconditioning band 472 (see, e.g., FIG. 10), and/or other suitable reconditioning device, for example. In one embodiment, referring to FIGS. 5 and 6, the reconditioning member assembly 127 may comprise the reconditioning roll 126, which is configured to rotate about a longitudinal axis 171 of the reconditioning roll 126. The longitudinal axis 171 of the reconditioning roll 126 may be parallel to, or substantially parallel to, the longitudinal axis 133 of the anvil roll 124. In one embodiment, the reconditioning roll 126 may be rotatably connected with the frame 110 (see e.g., FIGS. 3 and 4) and may be rotatably mounted to apertures 139 and 137 of the side plates 108 and 109, respectively, of the frame 110 using bearings 150 of the reconditioning member assembly 127. For example, the openings 137 and 139 may be formed with a bearing surface which may allow the reconditioning roll 126 to be directly mounted within the openings 137 and 139. In one embodiment, the bearings 150 may be generally the same in structure and function as the bearings 144, discussed above, for example.

In one embodiment, the reconditioning roll 126 may be driven by a motor assembly 182 comprising a power source and any suitable motor or other device for imparting a rotation upon a shaft 148 of the reconditioning roll 126. The motor assembly 182 may be configured to be engaged with the shaft 148 of the reconditioning roll 126 through a drive shaft 185, for example. In one embodiment, the reconditioning roll 126 may rotate in the direction generally indicated by arrow 166 and the anvil roll 124 may rotate in the direction generally indicated by arrow 162. As is illustrated, the direction indicated by arrow 166 may be the same direction as the direction indicated by arrow 162, for example. In other various embodiments, the direction indicated by arrow 166 may be different than, or opposite to, the direction indicated by arrow 162. In one embodiment, the anvil roll 124 and the reconditioning roll 126 may rotate at rotational speeds which may cause a tangential speed of the outer radial surface 129 of the anvil roll 124 to be different than the tangential speed of an outer surface of the reconditioning roll 126 at the point of contact thus creating relative movement between the anvil roll 124 and the reconditioning roll 126. For example, the anvil roll 124 may rotate with a rotational speed that provides the outer radial surface 129 with a tangential speed of 20 meters per second, and the reconditioning roll 126 may rotate with a rotational speed that provides the outer surface of the reconditioning roll 126 with a tangential speed of 10 meters per second. The difference between the tangential speed of the outer radial surface 129 of the anvil roll 124 and the tangential speed of the outer surface of the reconditioning roll 126 may create a speed differential between a surface speed of the outer radial surface 129 of the anvil roll 124 and the outer surface of the reconditioning roll 126 and may create relative movement between the outer radial surface 129 of the anvil roll 124 and the outer surface of the reconditioning roll 126. The rotational speeds and tangential speeds of the anvil roll 124 and reconditioning roll 126 may occur in any suitable range for the application of the anvil reconditioning.

In one embodiment, referring to FIGS. 3-6, the reconditioning roll 126 may comprise an abrasive surface 192 and/or an abrasive material on the abrasive surface 192. The abrasive surface 192 may be positioned on an outer radial surface of the reconditioning roll 126. In one embodiment, the abrasive surface 192 may comprise an abrasive material, such as calcium carbonate, emery, diamond dust, novaculite, pumice dust, sand, borazon, ceramic aluminum oxide, ceramic iron oxide, corundum, glass powder, silicon carbide, zirconia alumina, and/or any other suitable abrasive material, for example. In various embodiments, the abrasive surface 192 may be engaged with or placed in contact with the outer radial surface 129 of the anvil roll 124. In one embodiment, the outer radial surface 129 of the anvil roll 124 may move relative to the abrasive surface 192 and/or the abrasive surface 192 can move relative to the anvil roll 124. In one embodiment, the reconditioning member can be or remain stationary, for example, and the anvil roll 124 can move relative to the reconditioning member.

In one embodiment, referring to FIGS. 3-6, the abrasive surface 192 of the reconditioning roll 126 may be moved relative to the outer radial surface 129 of the anvil roll 124 a distance 199 in a first direction and then moved the same, or substantially the same, distance 199 in a second, opposite, or a substantially opposite, direction. In various embodiments, the abrasive surface 192 of the reconditioning roll 126 may define a first longitudinal length 195 and the outer radial surface 129 of the anvil roll 124 may define a second longitudinal length 193. The first longitudinal length 195 may be greater than or equal to the second longitudinal length 193 or, in other embodiments, although not illustrated, the first longitudinal length may be less than the second longitudinal length. In one embodiment, the first longitudinal length 195 may be equal to, or greater than, the sum of the second longitudinal length 193 plus the distance 199, for example.

In one embodiment, again referring to FIGS. 3-6, the reconditioning member assembly 127 may comprise an actuator 159 configured to move the reconditioning roll 126 in the directions generally indicated by arrows 160. The actuator 159 may comprise any actuator suitable for moving the reconditioning roll 126 in a linear direction, such as a hydraulic actuator, a pneumatic actuator, an electric actuator, a linear actuator, and/or any other suitable actuator, for example. In one embodiment, the actuator 159 can comprise a piston 157 attached to a portion of the reconditioning member assembly 127 at the distal end of the piston 157, for example. As a result, the piston 157 can extend from a housing of the actuator 159 to move the reconditioning member assembly 127, or at least the reconditioning roll 126, away from the actuator 159. Similarly, as the piston 157 is retracted into the housing of the actuator 159, the reconditioning member assembly 127, or at least the reconditioning roll 126, can be moved toward the actuator 159. In one embodiment, the actuator 159 may cause the reconditioning member 126 to move in a direction which is substantially parallel to a longitudinal axis 161 between the abrasive surface 192 and the outer radial surface 129 of the anvil roll 124. In one embodiment, the actuator 159 can move the reconditioning roll 126 in a reciprocating motion in the directions indicated generally by the arrows 160. In one embodiment, the reconditioning member assembly 127 may be operatively engaged with an actuator (not illustrated) configured to move the reconditioning member such as the reconditioning roll 126 towards the outer radial surface 129 of the anvil roll 124 to allow the abrasive surface 192 to maintain the pressure exerted by the abrasive surface 192 on the outer radial surface 129 and permit the reconditioning and/or polishing of the outer radial surface 129 of the anvil roll 124 to occur.

In one embodiment, still referring to FIGS. 3-6, the abrasive surface 192 of the reconditioning roll 126 may be configured to recondition and/or polish the anvil roll 124 such that that anvil roll 124 maintains its cylindrical shape and/or maintains a uniform surface, for example. In various embodiments, the abrasive surface 192 of the reconditioning roll 126 may recondition and/or polish the anvil roll 124 such that the reconditioning roll 126 maintains its cylindrical shape. The reconditioning and/or polishing of the anvil roll 124 may occur by removing a small amount material from the outer radial surface 129 of the anvil roll 124. This removal may occur in relatively small, or micro, amounts, as compared to reconditioning of anvil rolls with a blanket covering in which the blanket covering is removed at a macro rate. For example, reconditioning of anvil rolls with blanket coverings may remove 0.010 to 0.020 inches during each reconditioning cycle. The amount of the material removed from the outer radial surface 129 during the reconditioning and/or polishing of the anvil roll 124 can be in the range of 0.05 microns per million revolutions to 20 microns per million revolutions, for example. In one embodiment, the abrasive surface 192 may apply a force to the outer radial surface 129 of the anvil roll 124 to assist the abrasive surface 192 in reconditioning and/or polishing the outer radial surface 129 of the anvil roll 124. In one embodiment, the abrasive surface 192 of the reconditioning roll 126 may be configured to move towards the outer radial surface 129 of the anvil roll 124 as material is removed from the outer radial surface 129 to maintain the force applied by the abrasive surface 192 to the outer radial surface 129.

In one embodiment, again referring to FIGS. 3-6, the reconditioning member assembly 127 may be used in a method of reconditioning the outer radial surface 129 of the anvil roll 124. The method of reconditioning the anvil roll 124 may comprise rotating the die roll 120 in the direction generally indicated by arrow 164 using the motor assembly 180. The anvil roll 124 may be located in close proximity to the bearer rings 122, such that outer surfaces 141 of the bearer rings 122 can contact the outer radial surface 129 of the anvil roll 124. In such an embodiment, the outer radial surface 129 may be frictionally engaged with the outer surfaces 141 of the bearer rings 122 of the die roll 120. In another embodiment, the outer radial surface 129 of the anvil roll 124 may be in direct contact with the cutting members 152 of the die roll assembly 120, for example. In any event, the rotation of the die roll 120 may cause the bearer rings 122 to drive the anvil roll 124 in a direction generally indicated by arrow 162. The anvil roll 124 may rotate due to the forces exerted on the outer radial surface 129 of the anvil roll 124 (i.e., by the frictional engagement of the outer surfaces 141 of the bearer rings 122 with the outer radial surface 129 of the anvil roll 124. In other embodiments, as discussed above, the anvil roll 124 can be driven independent of the die roll 120.

In one embodiment, the rotation of the die roll 120 and the anvil roll 124 may cause the one or more cutting members 152 extending outwardly from the die roll 120 to cut material moving between the die roll 120 and the anvil roll 124 against the outer radial surface 129 of the anvil roll 124. In various embodiments, this cutting may be repeated on each rotation of the die roll 120 such that the cutting is continuous. In other embodiments, the cutting can be discontinuous. In one embodiment, the cutting may occur at a rate in the range of 15 meters per minute to 720 meters per minute, for example. The repeated cutting performed by the cutting members 152 against the anvil roll 124 may cause portions of the outer radial surface 129 to plastically deform at the point of contact of the cutting members 152 on the outer radial surface 129. This plastic deformation may be created due by the relative hardness of the cutting members 152 and the outer radial surface 129. For example, the cutting members 152 may have hardness in the range of 65 to 80 HRC and the outer radial surface 129 may have hardness in the range of 50-65 HRC, for example. In one embodiment, the cutting members 152 may be harder than the outer radial surface 129 of the anvil roll 124. The wear zones caused by the cutting members 152 may vary across the outer radial surface 129 of the anvil roll 124 depending on the frequency of the contact between the cutting members 152 and particular portions of the outer radial surface 129. In one embodiment, the plastic deformation of the outer radial surface 129 may cause the anvil roll 124 to be replaced after somewhere between 5 million and 50 million rotations. By reconditioning or continuously reconditioning the outer radial surface 129 during rotation of the anvil roll 124, the life of the anvil roll 124 and/or the outer radial surface 129 may be extended. In one embodiment, the life of the anvil roll 124 can be extended from 250 million cycles to 750 million cycles, for example.

Figure 3:
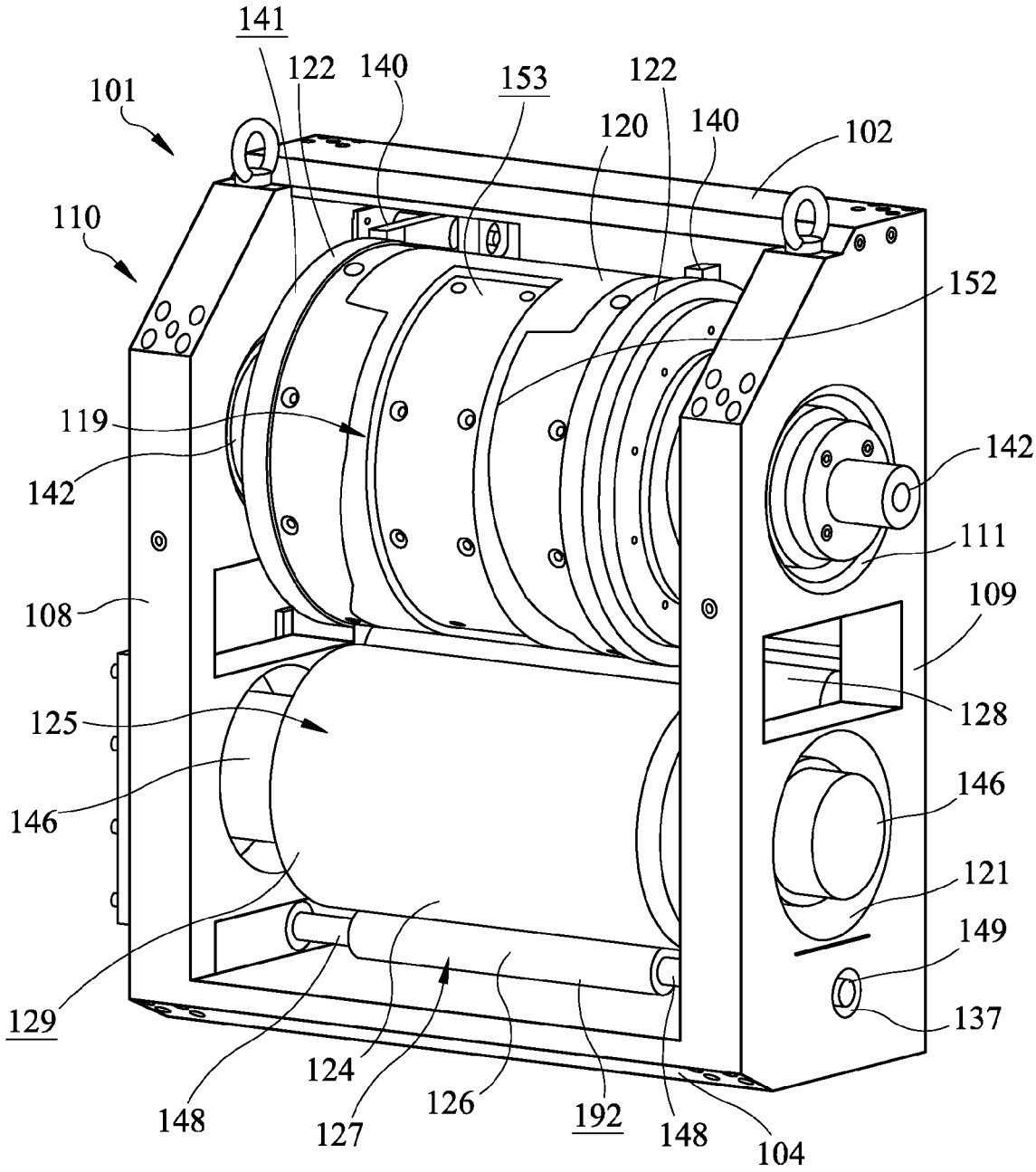
FIG. 3 is a front perspective view of a rotary cutting apparatus according to one non-limiting embodiment.
Figure 4:
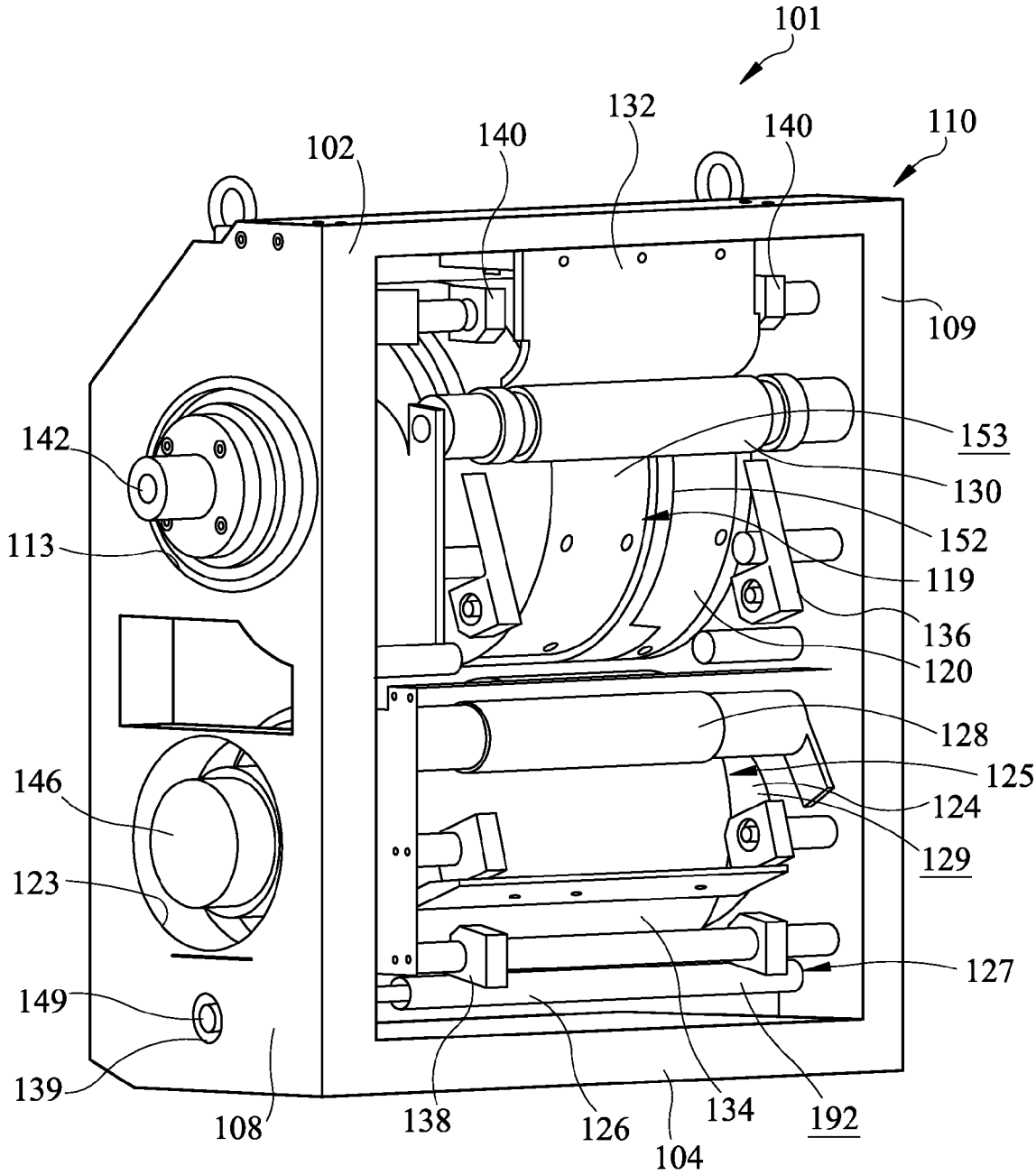
FIG. 4 is a rear perspective view the rotary cutting apparatus of FIG. 3 according to one non-limiting embodiment.

In one embodiment, referring to FIGS. 3 and 4, the rotary cutting apparatus 101 may comprise an anvil oiler roll 128, a die oiler roll 130, and/or an oiler roll feeder pad 132. In various embodiments, the anvil oiler roll 128 may apply oil and/or any other suitable lubricant to the anvil roll 124 and the oiler roll feeder pad 132 may apply oil and/or any other suitable lubricant to the die oiler roll 130, such that the die oiler roll 130 may apply the oil and/or any other suitable lubricant to the cutting members 152, for example. The oil and/or other suitable lubricant applied to the anvil roll 124 and/or the cutting members 152 of the die roll 120 may assist in processing a material passing between the anvil roll 124 and the die roll 120 by allowing the cutting members 152 to more easily cut the material owing to the reduced coefficient of friction between the cutting members 152 and the material, for example.

In one embodiment, still referring to FIGS. 3 and 4, the rotary cutting apparatus 101 may comprise an anvil scraper 134 and an anvil wiper 138. The anvil scraper 134 may comprise an edge formed of a hard or rigid material, such as a metal or a hard plastic, for example, to remove at least some of any unwanted and/or excess material from the anvil roll 124. The edge of the anvil scraper 134 may engage the outer radial surface 129 of the anvil roll 124 to remove unwanted and/or excess material from the outer radial surface 129 of the anvil roll 124. For example, excess melted glue, which may result from later and/or earlier manufacturing using hot melt glue within a production line of the rotary cutting apparatus 101, may collect on or around the outer radial surface 129 of the anvil roll 124, and the anvil scraper 134 may remove this melted glue from the outer radial surface 129. In one embodiment, the anvil wiper 138 may comprise a soft or flexible material, such as felt, rubber, and/or any other suitable soft or flexible material, for example, to wipe the anvil roll 124 clean. The anvil wiper 138 may be configured to work in conjunction with the anvil scraper 134 to remove unwanted and/or excess material from the outer radial surface 129 of the anvil roll 124. In one embodiment, the anvil wiper 138 may be engaged with the anvil roll 124 and/or the anvil scraper 134 to remove the unwanted and/or the excess material from the outer radial surface 129 of the anvil roll 124 and/or from the anvil scraper 134.

In one embodiment, referring again to FIGS. 3 and 4, the rotary cutting apparatus 101 may comprise a bearer scraper 136 configured to scrape unwanted material from the bearer rings 122 in a manner similar to that of the anvil scraper 134. The bearer scraper 136 may comprise an edge formed from a rigid or a hard material, such as a metal or hard plastic, to remove unwanted material, such as hot melt glue, from the bearer rings 122. The edge of the bearer scraper 136 may be configured to engage the outer surfaces 141 of the bearer rings 122 and remove excess material from the outer surfaces 141 of the bearer rings 122.

In one embodiment, referring again to FIGS. 3 and 4, the rotary cutting apparatus 101 may comprise a die roll wiper 140. The die roll wiper 140 may comprise a flexible and/or a soft material, such as felt or any other suitable flexible and/or soft material, to wipe the cutting members 152 positioned on or formed with the die roll 120. The die roll wiper 140 may be configured to be engaged with the cutting members 152 to remove any excess material or other waste, such as the melted glue or die cut fragments from cut material, for example, from the cutting members 152.

Additional details regarding rotary cutting apparatuses can be found in U.S. Pat. No. 6,609,997, issued on Aug. 26, 2003, entitled "Method and Apparatus for Resurfacing Anvil Blanket of a Rotary Diecutter for Box Making Machine" to Sardella et al., U.S. Pat. No. 6,684,747, issued on Feb. 3, 2004, entitled "Cutting Machine, Cutting Tool, and Anvil Roller" to Aichele, and U.S. Pat. No. 6,913,566, issued on Jul. 5, 2005, entitled "Size Adjustment of Corrugated Boards in a Box Making Machine" to Polikov et al., all of which are all hereby incorporated by reference in their entirety.

Figure 8:
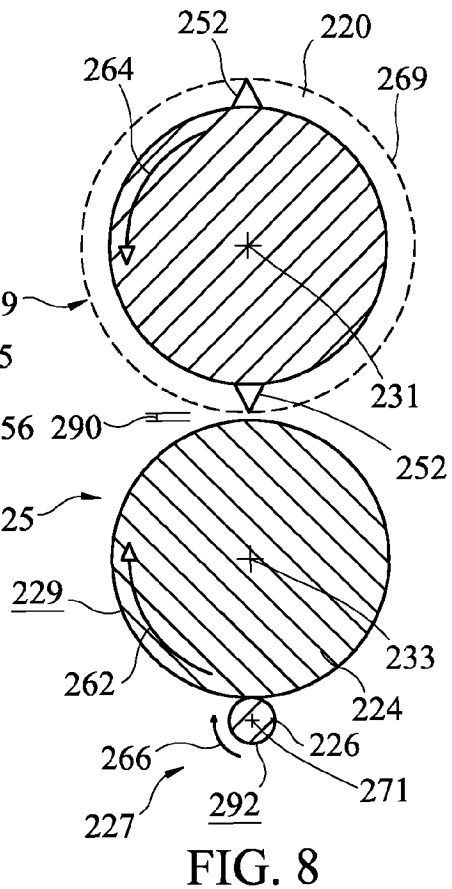
FIG. 8 is a cross-sectional view of the rotary cutting assembly taken along line 8-8 of FIG. 7 according to one non-limiting embodiment.
Figure 7:
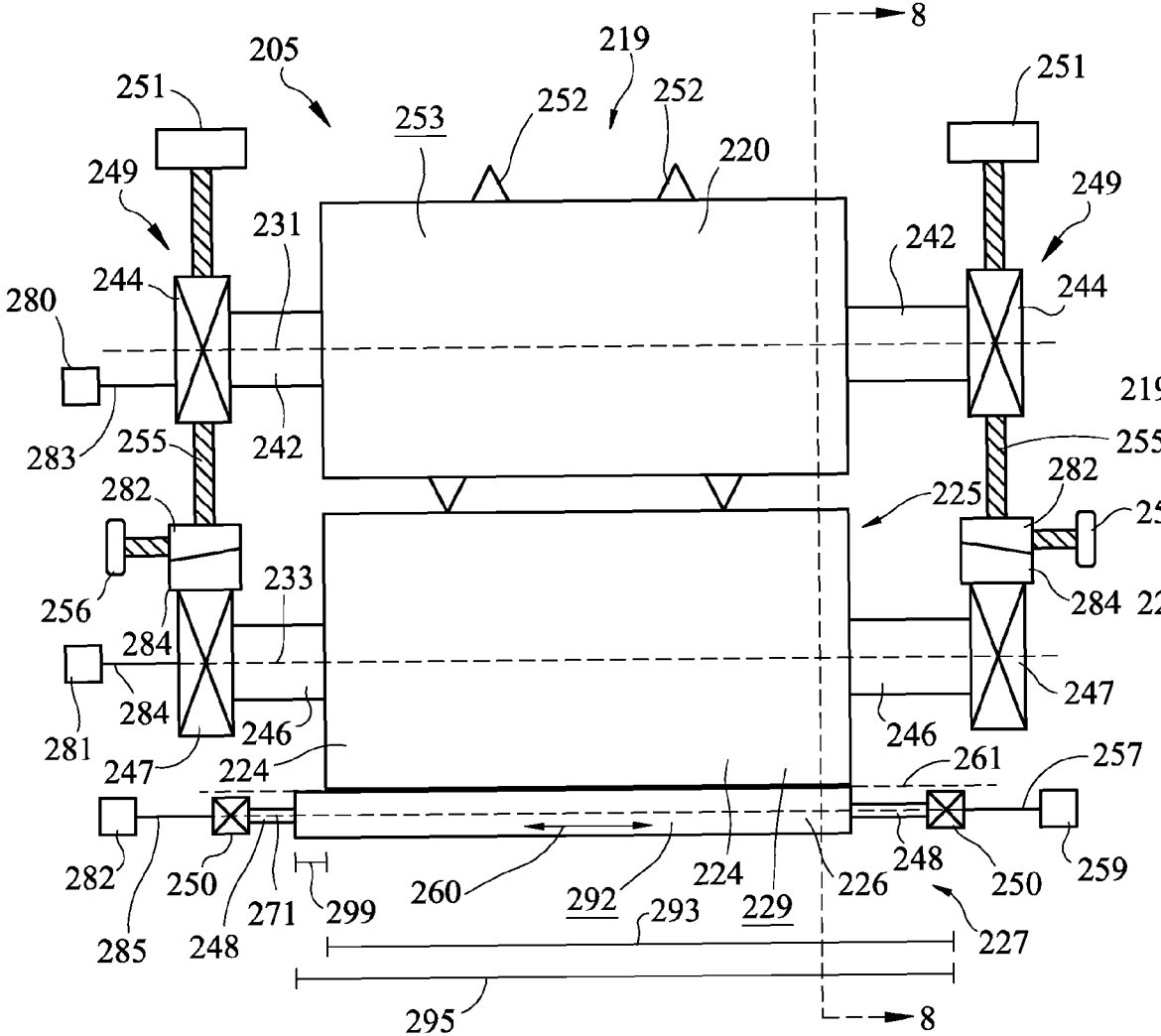
FIG. 7 is a schematic illustration of a rotary cutting assembly configured to be mounted to a frame of a rotary cutting apparatus according to one non-limiting embodiment.

In one embodiment, referring to FIGS. 7 and 8, a rotary cutting assembly 205 may comprise a die roll assembly 219 comprising a die roll 220 configured to rotate about a longitudinal axis 231 in a direction generally indicated by arrow 264, an anvil roll assembly 225 comprising an anvil roll 224 configured to rotate about a longitudinal axis 233 in a direction generally indicated by arrow 262, and a reconditioning member assembly 227 comprising a reconditioning member, such as a reconditioning roll 226, for example, configured to rotate about a longitudinal axis 271 in a direction generally indicated by arrow 266. The components with corresponding reference numerals (e.g., 119, 219) can have the same or a similar structure and function as discussed above, unless otherwise noted. As such, these components will not be discussed in detail again here for the sake of brevity.

In one embodiment, referring again to FIGS. 7 and 8, the anvil roll 224 may be movably connected with the frame 10, such as engaged with slots in the frame 10, for example, to allow a distance 290 between an outer radial surface 229 of the anvil roll 224 and cutting members 252 located on the die roll 220 to be increased and/or decreased. The cutting members 252 may be configured to be rotated about the longitudinal axis 231 in an orbital path 269 about the outer surface 253 of the die roll 220. The distance 290 may be controlled using one or more adjustment assemblies 249. In the example embodiment illustrated in FIG. 7, two adjustment assemblies 249 can be used by the rotary cutting assembly 205. One adjustment assembly 249 may be engaged with each side plate 8 and 9 between the top plate 2 and the bottom plate 4 of the frame 10, for example, and may be configured to adjust the distance 290 between the orbital path 269 of the cutting members 252 positioned on the die roll 220 and the outer radial surface 229 of the anvil roll 224. For example, the adjustment assemblies 249 may be engaged with each side plate 8 and 9 of the frame 10 and may be configured to move bearings 244 of the die roll assembly 219 either towards or away from bearings 247 of the anvil roll assembly 225. In one embodiment, the adjustment assemblies 249 may comprise an arrangement where the distance 290 is controlled using one or more adjustment devices 251. The adjustment devices 251 can be screws (FIG. 7), threaded members, hydraulic actuators, pneumatic actuators, and/or any other suitable adjustment devices, for example. Of course, suitable handles can be provided on the screws or the threaded members.

In one embodiment, the adjustment device 251 may adjust the distance 290 by adjusting the length of an adjustment shaft 255 positioned between the bearings 244 of the die roll assembly 219 and the bearings 247 of the anvil roll assembly 225. The adjustment shaft 255 may comprise any suitable shaft for making an adjustment in the distance 290, such as a threaded shaft (FIG. 7), for example. In one embodiment, the adjustment shafts 255 of the adjustment assemblies 249 may extend between the bearings 244 of the die roll assembly 119 and the bearings 247 of the anvil roll assembly 225. In various embodiments, the adjustment device 251 may be used in making adjustments to the distance 290. These adjustments may be made to allow the web of material to be fed between the cutting members 252 and the outer surface 229 or to adjust the distance 290 for a cutting member 252 with a different pitch or height.

In one embodiment, still referring to FIGS. 7 and 8, the adjustment assembly 249 may also comprise a micro-adjustment device 256 and two opposing tapered wedges 282 and 284. The micro-adjustment device 256 may also use any member or members suitable for adjusting the distance 290. In one embodiment, the micro-adjustment device 256 may comprise a screw (FIG. 7), a hydraulic actuator, a pneumatic actuator, and/or any other suitable adjustment device, for example. The micro-adjustment device 256 may be used to make micro adjustments to the distance 290, typically in the range of 0.5 microns to 20 microns. The micro-adjustment device 256 may cause the opposing tapered wedges 282 and 284 to move relative to each other thereby either increasing or decreasing the distance 290. In various embodiments, more than one micro-adjustment device 256 may be used.

In one embodiment, the adjustment device 251 may be controlled by any suitable control system including an automated electronic control system, a manually movable member, such as a handle of a threaded portion, for example, and/or a hydraulic or pneumatic actuator. In various embodiments, the adjustment device 251 may be operably engaged with a motor assembly (not shown), which may comprise a motor, a drive shaft, and a power source, to move the adjustment device 251 to adjust the distance 290. In one embodiment, the micro-adjustment device 256 may be controlled by any suitable control system including an automated electronic control system, a manually movable member, such as a handle of a threaded portion, for example, and/or a hydraulic or pneumatic actuator. In one embodiment, the micro-adjustment device 256 may be operably engaged with a motor assembly (not illustrated), which may comprise a motor, a drive shaft, and a power source, to move the micro-adjustment device 256 and adjust the distance 290.

Figure 9:
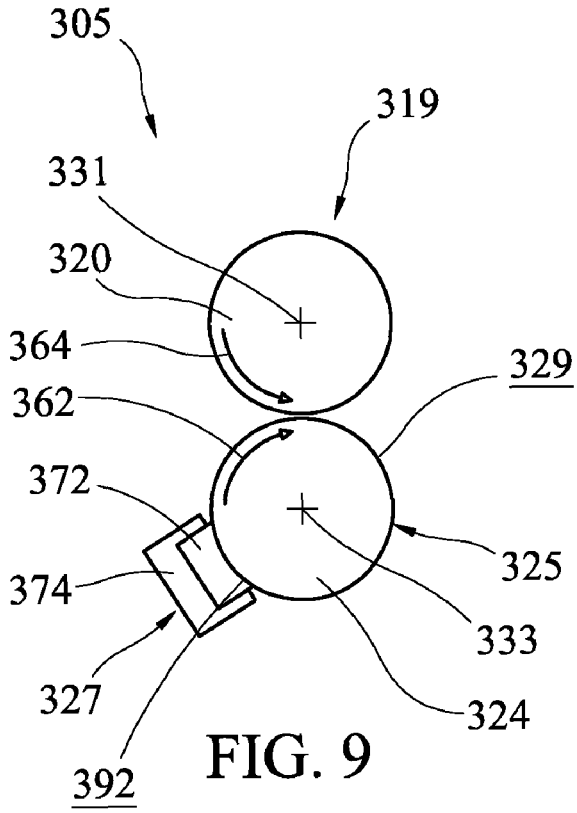
FIG. 9 is a schematic illustration of a rotary cutting assembly according to one non-limiting embodiment.

In one embodiment, referring to FIG. 9, a rotary cutting assembly 305 may comprise a die roll assembly 319 comprising a die roll 320 configured to rotate about a longitudinal axis 331 in a direction generally indicated by arrow 364, and an anvil roll assembly 325 comprising an anvil roll 324 configured to rotate about a longitudinal axis 333 in a direction generally indicated by arrow 362. The rotary cutting assembly 305 may further comprise a reconditioning member assembly 327. The reconditioning member assembly 327 may comprise a reconditioning member, such as a reconditioning pad 372 and a carrier 374, for example. In one embodiment, the reconditioning pad 372 may comprise an abrasive surface 392. The abrasive surface 392 may comprise an abrasive material such as, calcium carbonate, emery, diamond dust, novaculite, pumice dust, sand, borazon, ceramic aluminum oxide, ceramic iron oxide, corundum, glass powder, silicon carbide, zirconia alumina, and/or any other suitable abrasive material, for example. In one embodiment, the abrasive surface 392 may comprise any abrasive pad, such as a glass bead imbedded pad, for example, suitable for grinding and/or polishing an outer radial surface 329 of the anvil roll 324. In one embodiment, the reconditioning pad 372 may extend across, or partially across, a longitudinal length of the outer radial surface 329 of the anvil roll 324, similar to the reconditioning roll 126 relative to the outer radial surface 129, as discussed above (see e.g., FIG. 5). In other embodiments, the reconditioning pad 372 may have other suitable lengths, widths and/or dimensions. The reconditioning member assembly 327, or at least the reconditioning pad 372, may be moved using an actuator having an extendable and retractable piston, for example. The actuator and piston can be similar in structure and function to the actuator 159 and the piston 157 discussed above and can be configured to move the reconditioning pad 372 in a reciprocating motion relative to the outer radial surface 329, similar to that discussed above. In one embodiment, the reconditioning member assembly 327 can also be forced toward the outer radial surface 329 of the anvil roll 324 using any suitable actuator such that the reconditioning pad 372 can apply a force to the outer radial surface 329.

Figure 10:
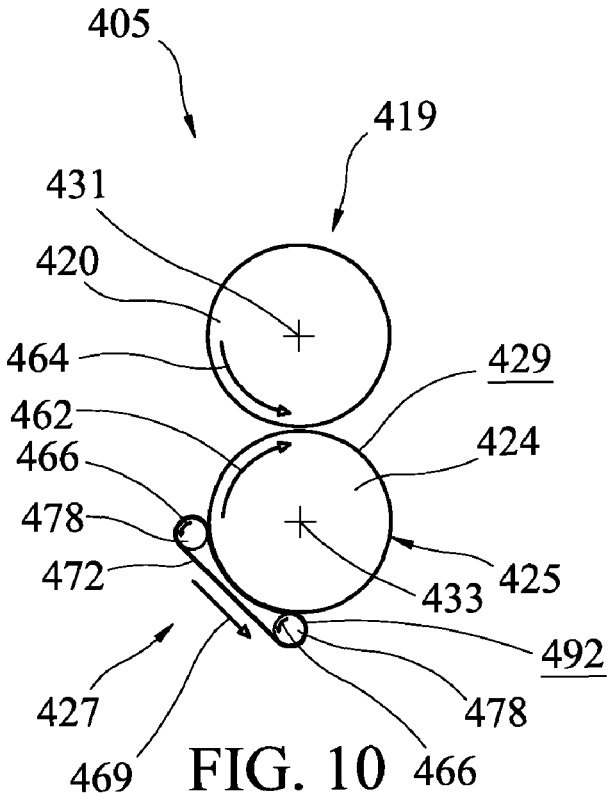
FIG. 10 a schematic illustration of a rotary cutting assembly according to one non-limiting embodiment.

In one embodiment, referring to FIG. 10, a rotary cutting assembly 405 may comprise a die roll assembly 419 comprising a die roll 420 configured to rotate about a longitudinal axis 431 in a direction generally indicated by arrow 464, and an anvil roll assembly 425 comprising an anvil roll 424 configured to rotate about a longitudinal axis 433 in a direction generally indicated by arrow 462. The rotary cutting assembly 405 may further comprise a reconditioning member assembly 427. The reconditioning member assembly 427 may comprise a reconditioning member, such as a reconditioning belt 472 and at least one roller 478, for example. In one embodiment, the reconditioning belt 472 may be an endless belt configured to rotate about at least two rollers 478. The reconditioning belt 472 may comprise an abrasive surface 492, similar to the abrasive surfaces discussed above.

In one embodiment, still referring to FIG. 10, the rollers 478 may be configured to rotate in a direction generally indicated by arrow 466 such that the rollers can drive the reconditioning belt 472 in a direction indicated by arrow 469. In one embodiment, the rollers 478 may rotate in the opposite direction causing the reconditioning belt 472 to rotate about the rollers 478 in the opposite direction, for example. The anvil roll 424 may be configured to rotate in the direction generally indicated by arrow 462. In one embodiment, the direction 469 of rotation of the reconditioning belt 472 may be the same as, or substantially the same as, the direction 462 of rotation of the anvil roll 424. In other embodiments, the direction of rotation of the reconditioning belt 472 may be opposite to, or substantially opposite to, the direction of rotation of the anvil roll 424. The reconditioning belt 472 may extend across, or partially across, a longitudinal length of the outer radial surface 429 of the anvil roll 424, similar to the reconditioning roll 126 relative to the outer radial surface 129, as discussed earlier (see e.g., FIG. 5). In other embodiments, the reconditioning belt 472 may have any other suitable lengths, widths, and/or dimensions. The reconditioning belt 472 may be configured to conform to an arcuate portion of the anvil roll 424 as the reconditioning belt 472 is driven by the rollers 478. The reconditioning member assembly 427, or at least the reconditioning belt 472 and the rollers 478, may be moved using an actuator having an extendable and retractable piston, for example. The actuator and the piston can be similar in structure and function to the actuator 159 and the piston 157 discussed above and can be configured to move the reconditioning belt 472 in a reciprocation motion relative to the outer radial surface 429, similar to that discussed above. In one embodiment, the reconditioning member assembly 427 or, at least the reconditioning belt 472 and rollers 475, can also be forced toward the outer radial surface 429 of the anvil roll 424 using any suitable actuator to apply pressure to the outer radial surface 429.

In one embodiment, the reconditioning belt 472 may be configured to be tensioned to allow various pressures, or ranges of pressures, to be applied to an outer radial surface 429 of the anvil roll 424. For example, more tension may be applied to the reconditioning belt 472 to apply a greater pressure to the outer radial surface 429 thus increasing an amount of material removed from the outer radial surface 429, or less tension may be applied to the reconditioning belt 472 to apply a lesser pressure to the outer radial surface 429 thus reducing the amount of material removed from the outer radial surface 429. The tension of the reconditioning belt 472 may be increased and/or decreased by moving the rollers 478 toward or away from each other, for example. For example, the tension of the reconditioning belt 472 may be increased by increasing the distance between the rollers 478, or the tension of the reconditioning belt 472 may be decreased by decreasing the distance between the rollers 478. The distance between the rollers 478 may be controlled by any actuator suitable for moving the rollers 478 in a linear direction, such as a hydraulic actuator, a pneumatic actuator, an electric actuator, a linear actuator, and/or any other suitable actuator, for example. In other various embodiments, the rollers 478 can be moved toward or away from each other manually.

Figure 11:
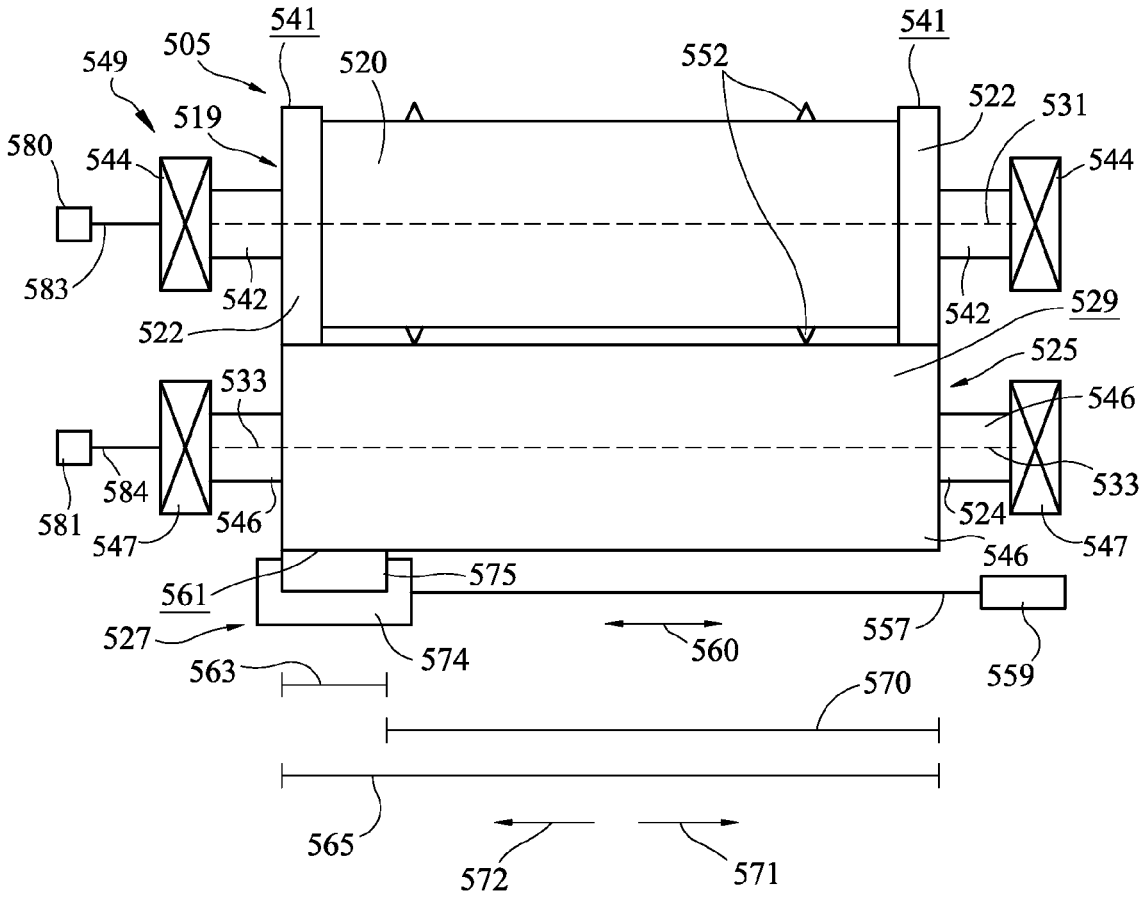
FIG. 11 is a schematic illustration of a rotary cutting assembly according to one non-limiting embodiment.

In one embodiment, referring to FIG. 11, a rotary cutting assembly 505 may comprise a die roll assembly 519 comprising a die roll 520 configured to rotate about a longitudinal axis, and an anvil roll assembly 525 comprising an anvil roll 524 configured to rotate about a longitudinal axis 533. The rotary cutting assembly 505 may further comprise a reconditioning member assembly 527. In such an embodiment, the reconditioning member assembly 527 may comprise a reconditioning member and a carrier 574 configured to hold the reconditioning member. In one embodiment, the reconditioning member may comprise a reconditioning pad 575 comprising an abrasive surface 561. In various other embodiments, the reconditioning member assembly 527 may comprise a reconditioning roll, similar to the reconditioning rolls discussed above. In various other embodiments, the reconditioning member assembly 527 may comprise a reconditioning belt and at least one roller, similar to the reconditioning belt and rollers discussed above. The reconditioning pad 575 may comprise an abrasive surface 592 similar to the abrasive surfaces discussed above. In one embodiment, the reconditioning pad 575 may be engaged with an actuator 559 comprising a piston 557. The piston 557 can be connected with the reconditioning pad 575 and/or the carrier 574 and can be configured to move the reconditioning pad 575, in a reciprocating motion indicated by an arrow 560, when the piston 557 is extended from and retracted into the actuator 559. The reciprocating motion of the reconditioning pad 575 is defined by movement of the reconditioning pad 575 a distance 570 in a first direction 571 and movement of the reconditioning pad 575 the distance 570 in a second direction 572 opposite to the first direction 571. In one embodiment, the movement of the reconditioning pad 575 over the distance 570 may allow the reconditioning pad 575 to cover a distance 565 of a longitudinal length of the anvil roll 524. The abrasive surface 561 of the reconditioning pad 575 may define a longitudinal length 563 and an outer radial surface 529 of the anvil roll 524 may define the distance 565. In one embodiment, the longitudinal length 563 may be less than the distance 565. In other embodiments, the distance 565 may be less than or equal to the sum of the distance 570 plus the longitudinal length 563, for example.

In one embodiment, the actuator 559 may accelerate and decelerate the reconditioning pad 575 in a reciprocating motion relative to the outer radial surface 529 so as to maintain a substantially constant contact time between the abrasive surface 561 and the outer radial surface 529 of the anvil roll 524. A control system may control the actuator 559 to cause the reconditioning pad 575 to remove material from the anvil roll 524 evenly across the distance 565 of the anvil roll 524. In one embodiment, the material may be removed from anvil roll 524 to allow the anvil roll 524 to maintain its cylindrical shape.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A rotary cutting apparatus comprising:

a frame;

a die roll defining a first longitudinal axis and comprising a cutting member, wherein the die roll is rotatably connected with the frame and configured to rotate about the first longitudinal axis;

a bearer ring connected with the die roll;

an anvil roll defining a second longitudinal axis and comprising an outer radial surface, wherein the anvil roll is rotatably connected with the frame and is configured to rotate about the second longitudinal axis, the anvil roll positioned relative to the die roll such that the bearer ring is in contact with the outer radial surface and such that the first longitudinal axis is substantially parallel with the second longitudinal axis; and a reconditioning member comprising an abrasive surface engaged with the outer radial surface of the anvil roll, wherein the outer radial surface of the anvil roll moves relative to the abrasive surface.

2. The rotary cutting apparatus of claim 1, further comprising an actuator connected with the reconditioning member producing a relative motion substantially parallel to the second longitudinal axis between the abrasive surface and the outer radial surface of the anvil roll.

3. The rotary cutting apparatus of claim 2, wherein the actuator is connected with the reconditioning member to move the reconditioning member in a reciprocating motion;

wherein the reciprocating motion of the reconditioning member is defined by movement of the reconditioning member a first distance in a first direction and by movement of the reconditioning member the first distance in a second direction opposite the first direction;

wherein the abrasive surface defines a first longitudinal length and the outer radial surface of the anvil roll defines a second longitudinal length; and wherein the first longitudinal length is equal to or greater than the sum of the second longitudinal length plus the first distance.

4. The rotary cutting apparatus of claim 2, wherein the actuator is connected with the reconditioning member to move the reconditioning member in a reciprocating motion;

wherein the reciprocating motion of the reconditioning member is defined by movement of the reconditioning member a first distance in a first direction and by movement of the reconditioning member the first distance in a second direction opposite the first direction;

wherein the abrasive surface defines a first longitudinal length and the outer radial surface of the anvil roll defines a second longitudinal length, wherein the first longitudinal length is less than the second longitudinal length; and wherein the second longitudinal length is less than or equal to the sum of the first distance plus the first longitudinal length.

5. The rotary cutting apparatus of claim 1, wherein the reconditioning member comprises a roller configured to rotate about a third longitudinal axis, wherein the third longitudinal axis is substantially parallel with the second longitudinal axis, and wherein the abrasive surface is positioned on an outer surface of the roller.

6. The rotary cutting apparatus of claim 5, wherein the abrasive surface has a first tangential speed and the outer radial surface has a second tangential speed, and wherein the first tangential speed is different than the second tangential speed such that relative movement between the abrasive surface and the outer radial surface occurs.

7. The rotary cutting apparatus of claim 1, wherein the reconditioning member comprises a pad.

8. The rotary cutting apparatus of claim 1, wherein the reconditioning member comprises a belt.

9. The rotary cutting apparatus of claim 8, wherein the belt is an endless belt, and wherein the reconditioning member further comprises at least two rollers supporting the endless belt.

10. The rotary cutting apparatus of claim 1, wherein the die roll rotates in a first direction and the anvil roll rotates in a second direction, and wherein the first direction is opposite to the second direction.

11. The rotary cutting apparatus of claim 10, wherein the cutting member rotates at a first speed and the outer radial surface of the anvil roll rotates at a second speed, and wherein the first speed is substantially the same as the second speed.

12. The rotary cutting apparatus of claim 1, wherein the anvil roll comprises an anvil surface material comprising one of tungsten carbide and tool steel.

13. A rotary cutting apparatus comprising:

a frame;

a die roll defining a first longitudinal axis and comprising a cutting member, wherein the die roll is rotatably connected with the frame and configured to rotate about the first longitudinal axis;

an anvil roll defining a second longitudinal axis and comprising an outer radial surface, wherein the anvil roll is rotatably connected with the frame and is configured to rotate about the second longitudinal axis, the anvil roll being movably connected with the frame to allow a distance between the outer radial surface of the anvil roll and the cutting member to be increased and decreased;

a reconditioning member comprising an abrasive surface engaged with the outer radial surface of the anvil roll, wherein the outer radial surface of the anvil roll moves relative to the abrasive surface; and an actuator connected with the reconditioning member to move the reconditioning member in a reciprocating motion, wherein the reciprocating motion of the reconditioning member is defined by movement of the reconditioning member a first distance in a first direction and by movement of the reconditioning member the first distance in a second direction opposite to the first direction, wherein the abrasive surface defines a first longitudinal length and the outer radial surface of the anvil roll defines a second longitudinal length, and wherein the first longitudinal length is equal to or greater than the sum of the second longitudinal length plus the first distance.

14. The rotary cutting apparatus of claim 13, wherein the reconditioning member comprises a roller configured to rotate about a third longitudinal axis, wherein the third longitudinal axis is substantially parallel with the second longitudinal axis, and wherein the abrasive surface is positioned on an outer surface of the roller.

15. The rotary cutting apparatus of claim 14, wherein the abrasive surface has a first tangential speed and the outer radial surface has a second tangential speed, and wherein the first tangential speed is different than the second tangential speed such that there exists a speed differential between a surface speed of the abrasive surface and a surface speed of the outer radial surface.

16. The rotary cutting apparatus of claim 13, wherein the anvil roll comprises an anvil surface material comprising one of tungsten carbide and tool steel.

17. A method of reconditioning a rotary cutting apparatus, the method comprising the steps of:

rotating a die roll, the die roll comprising a cutting member;

rotating an anvil roll, the anvil roll comprising an outer radial surface positioned in close proximity to the cutting member; and moving a reconditioning member comprising an abrasive surface a first distance in a first direction and a second direction opposite the first direction relative to the outer radial surface of the anvil roll, wherein the abrasive surface defines a first longitudinal length and the outer radial surface of the anvil roll defines a second longitudinal length, and wherein the first longitudinal length is equal to or greater than the sum of the second longitudinal length plus the first distance.

18. The method of claim 17, further comprising the step of:

frictionally engaging the outer radial surface of the anvil roll with the die roll.

19. The method of claim 17, wherein the anvil roll and the die roll rotate in opposite directions.

20. The method of claim 17, further comprising the step of:

rotating the abrasive surface at a first tangential speed different from a second tangential speed of the outer radial surface.

* * * * *